United States Patent [19]

Balliet

[11] Patent Number: 4,479,269

[45] Date of Patent: Oct. 30, 1984

[54] ATHLETIC PADDING

[75] Inventor: Karl E. Balliet, Bedford, Va.

[73] Assignee: Rubatex Corporation, Bedford, Va.

[21] Appl. No.: 448,509

[22] Filed: Dec. 9, 1982

[51] Int. Cl.[3] ..... A41D 13/00
[52] U.S. Cl. ..... 2/23
[58] Field of Search ..... 2/22, 23, 24; 5/464, 5/481

[56] References Cited

U.S. PATENT DOCUMENTS

| | | | |
|---|---|---|---|
| 2,818,571 | 1/1958 | Grant | 2/22 |
| 3,210,781 | 10/1965 | Pollock | 5/464 |
| 4,106,139 | 8/1978 | Southard | 5/481 X |
| 4,190,697 | 2/1980 | Ahrens | 5/481 X |
| 4,325,148 | 4/1982 | Livernois | 2/22 X |

FOREIGN PATENT DOCUMENTS

| | | | |
|---|---|---|---|
| 1188945 | 4/1970 | United Kingdom | 5/464 |
| 1258752 | 12/1971 | United Kingdom | 5/464 |

*Primary Examiner*—Louis K. Rimrodt
*Attorney, Agent, or Firm*—Mason, Fenwick & Lawrence

[57] ABSTRACT

A shock absorbing pad is formed of first and second interleaved constituent components of different hardness which are interleaved through the thickness of the pad for absorbing forces applied in the direction of the pad thickness. The pads are formed by die cutting interim pads from mats of the first and second materials with the pads comprising constituent components that are separable. The constituent components are separated and respectively associated with different constituent components formed of the other material to provide the desired pad formed of the two interleaved different materials.

15 Claims, 9 Drawing Figures

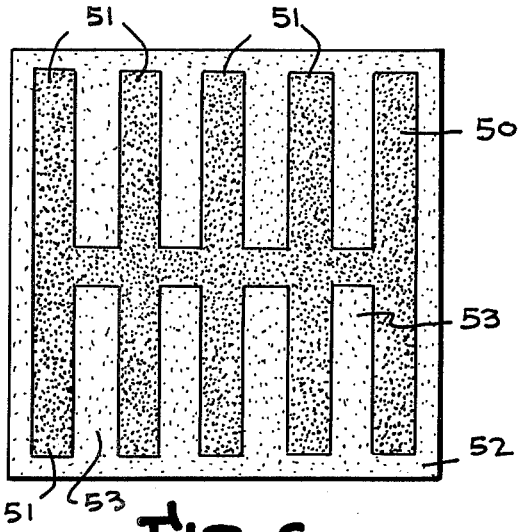
Fig-6
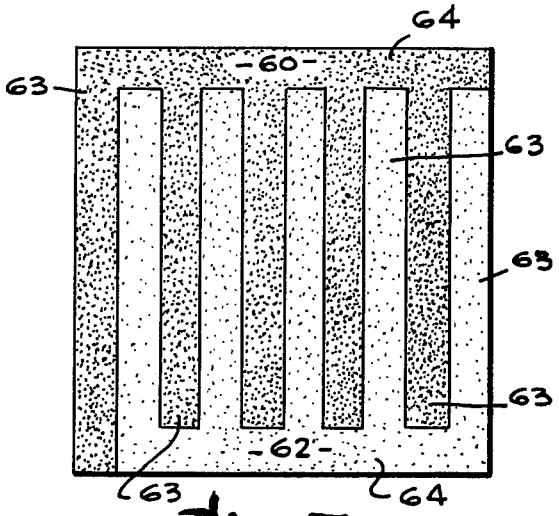
Fig-7
Fig-8
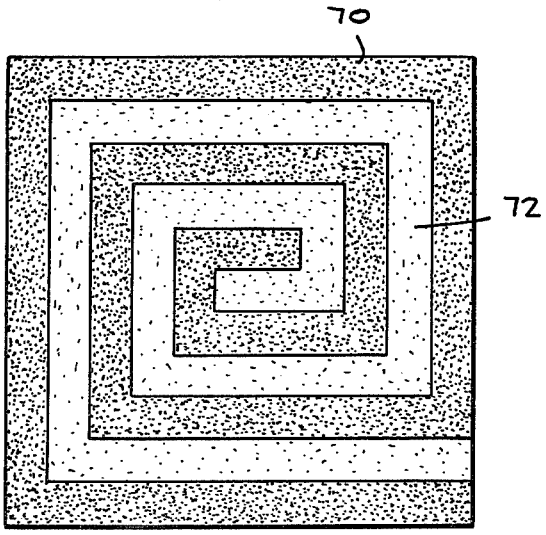
Fig-9
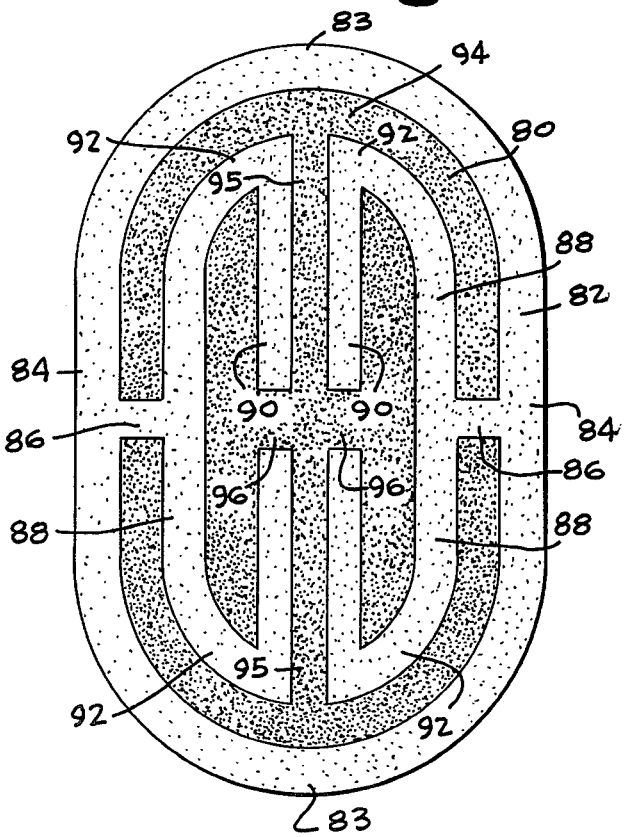

ATHLETIC PADDING

BACKGROUND OF THE INVENTION

The present invention is in the field of shock absorptive padding such as athletic equipment padding and the like. More specifically, the present invention is directed to a unique shock absorbing pad and a method of fabricating same.

It has been recognized for a number of years that athletic and other shock absorbing padding functions in an enhanced manner if the padding is formed of a plurality of materials of different hardness. Harris U.S. Pat. No. 2,980,167 discloses the basic combination of hard and soft materials in which the soft material comprises soft polyurethane foam in combination with a hard polyurethane foam. Similar disclosures are found in Montgomery U.S. Pat. No. 4,061,384 and Salloum U.S. Pat. No. 3,933,387. Other prior art comprises U.S. Pat. No. 2,697,578 to Whittam; U.S. Pat. No. 3,809,420 to Weller; U.S. Pat. No. 3,852,150 to Weller; U.S. Pat. No. 3,979,110 to Newton; U.S. Pat. No. 4,115,902 to Taylor; U.S. Pat. No. and 4,320,913 to Kuroda.

A shortcoming of the prior known constructions is that the fabrication of the common combination shock absorbing pad formed of a plurality of components having different hardness has always resulted in a substantial amount of waste material so as to consequently increase the cost of the composite pad. Also, prior known shock absorbing pads have frequently failed to provide uniform shock resistance over the entire body of the pad due to the geometric configuration and arrangement of the component parts.

Therefore, it is the primary object of the present invention to provide a new and improved shock absorbing pad that is economical to fabricate and also provides improved shock absorbing capacity.

Achievement of the foregoing object is enabled by the preferred embodiments in which each composite pad is formed of two mating interlocking constituent portions each formed of different materials of which one of the materials is substantially harder than the other material. The composite pads are formed by a unique fabrication technique in which individual mats of the two materials are cut by the single operation of a die which cuts the outline of the desired composite pad and the constituent portions. Interleaved, or transient, pads are consequently formed of a single material with the interim pads being identical to the desired final two-component pad in all respects other than being formed of a single material. Pads formed of a single material consisting of two interlocking halves are consequently formed to provide the interim pad. The two halves of the interim pad are then separated with each half being recombined with a mating half formed of the other product to provide a resultant composite shock absorbing pad one half of which is formed of the harder material and the other half of which is formed of the softer material. The pad halves can be held together by chemical bonding, stitching, or the like in conjunction with the inherent frictional retention of the interleaved components which operates to provide structural integrity for the composite pad.

A better understanding of the disclosed embodiments will be achieved when the following detailed description is considered in conjunction with the appended drawings in which like reference numerals are used for the same parts as illustrated in the different drawing figures.

BRIEF DESCRIPTION OF THE DRAWING

FIG. 6 is a top plan view of a second embodiment of the invention;

FIG. 7 is a top plan view of a third embodiment of the invention;

FIG. 8 is a top plan view of a fourth embodiment of the invention; and

FIG. 9 is a top plan view of a fifth embodiment of the invention.

DESCRIPTION OF THE PREFERRED EMBODIMENTS

Figure 1:
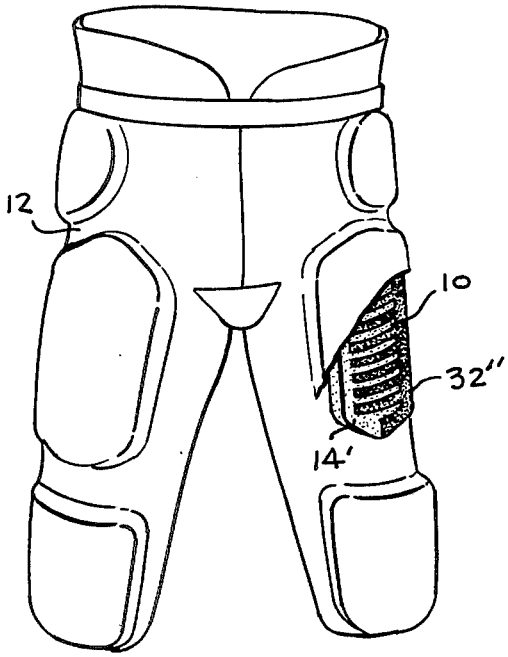
FIG. 1 is a perspective view of football pants using the inventive shock absorbing pad.

FIG. 1 of the drawings illustrates employment of the preferred embodiment of the invention, generally designated 10, as a thigh pad in football pants 12. Additionally, the preferred embodiment can also be employed in helmets and a wide variety of other athletic or other type equipment in which shock absorbing capacity and capability is required.

Figure 2:
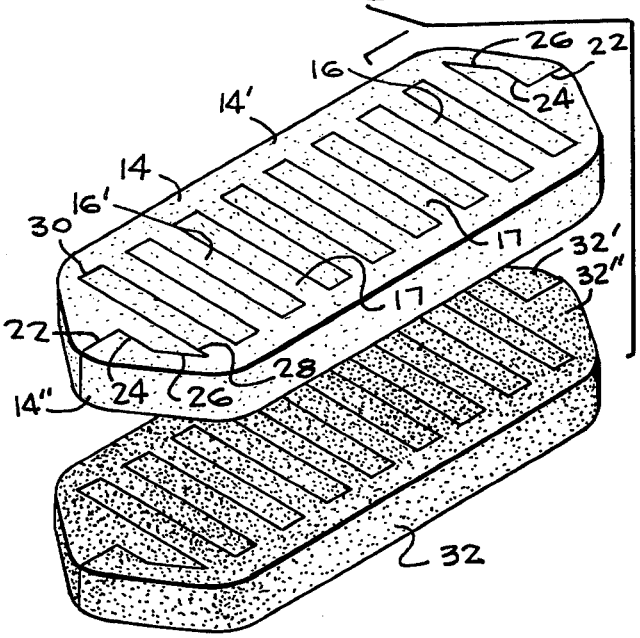
FIG. 2 is a perspective view of two interim, or transient, pads formed as an initial step in practice of the inventive method.
Figure 3:
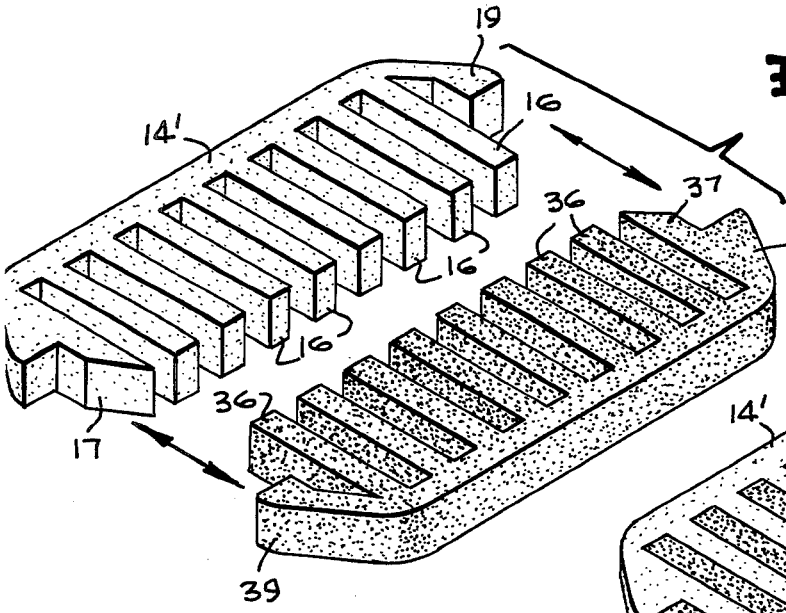
FIG. 3 is a perspective view illustrating a subsequent step in the practice of the inventive method.

Fabrication of the preferred embodiment is achieved by providing a mat of a first material having relatively soft character and a mat of a second material having a relatively hard character. More specifically, a blank of the relatively soft material is cut by a die to provide a relatively soft interim, or transient, pad 14 formed of constituent components 14' and 14'' that are interleaved together along cut lines 22, 24, 26, 28, 30, etc. which define parallel finger elements 16, 17, and 19 extending from common base elements of each respective constituent component as best shown in FIGS. 2 and 3. The soft interim, or transient, pad 14 has the same outline and is consequently of identical construction geometrically to the finished composite pad 40 illustrated in FIG. 4.

Figure 4:
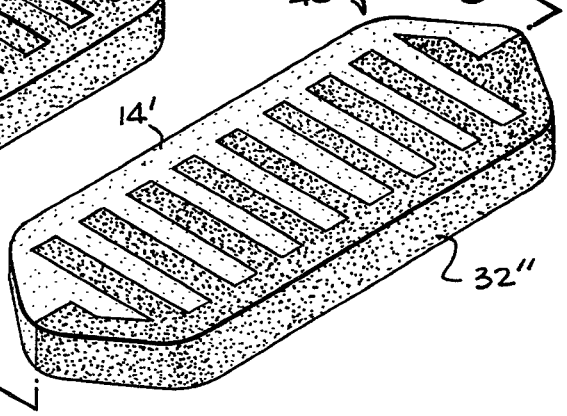
FIG. 4 is a perspective view illustrating a complete composite pad embodying the present invention.
Figure 5:
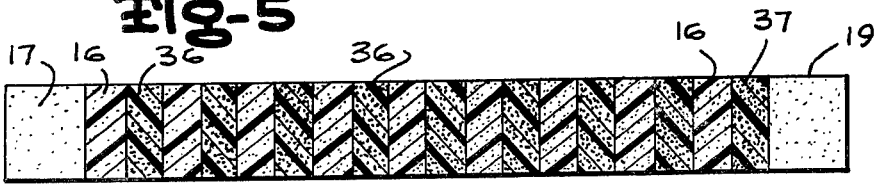
FIG. 5 is a sectional view taken along lines 5—5 of FIG. 4.

A similar hard interim pad 32 is similarly cut from a mat of harder material and is formed of pad halves 32' and 32'' which are identical geometrically to pad halves 14' and 14'' and which includes fingers 36, 37, and 39 respectively corresponding to fingers 16, 17, and 19 of the component 14'. The soft interim pad 14 is then separated into its two components 14' and 14'' and the hard interim pad 32 is similarly separated into its two components 32' and 32''. The soft component 14' is then associated with a hard component 32' as shown in FIG. 3 by an interleaved movement of the fingers of the components to provide a finished composite pad 40 as shown in FIG. 4. Similarly, the pad component 14'' is associated with a component 32' to provide an identical composite pad. Consequently, there is a minimum wastage of material and a highly effective shock absorbing pad is provided.

FIG. 6 illustrates an alternative embodiment consisting of a hard pad component 50 in the form of a series of "H" shaped elements including fingers 51 and a soft pad component 52 including fingers 53 interleavedly and matingly associated therewith. The pad of FIG. 6 is fabricated by cutting mats formed of the hard and soft materials with a single die to form interior pads in a manner similar to the method of the first embodiment. Thirdly, the interim pads formed of the soft material and the interim pads formed to form interior pads of the hard material respectively are separated and combined to provide two composite pads one of which is shown in FIG. 6. The other composite pad would be identical to that of FIG. 6 except for the fact the materials would be reversed with that the internal composite component 50 would be of the softer material and the external composite component 52 would be of the harder material.

FIG. 7 illustrates a third embodiment formed of a hard component 60 and a soft component 62 formed by cutting the components from soft and hard mats to form interim pads of constituent components each comprising a series of interconnected L-shaped elements including fingers 63 extending from base members 64, the constituent components of the interim pads are separated and recombined to provide dual component pads, one of which would be as shown in FIG. 7.

FIG. 8 illustrates a fourth embodiment of the invention in which a composite pad is formed of a hard component 70 and a soft component 72 with the components being in the form of square spirals. The components 70 and 72 are formed by a single die cutting operation providing interim pads in a manner similar to the first embodiment following which die cutting operation the sub components of the interim pads are separated and recombined to provide two composite pads, one of which is illustrated in FIG. 8. The other composite pad would be identical to that of FIG. 8 but would have the soft component being element 70 and the hard component being element 72 so as to provide a "reverse" positioning of the soft and hard components.

FIG. 9 illustrates yet another embodiment of the invention in which a composite pad is formed of a hard component 80 and a soft component 82 precut by a die cutting operation in the same manner as the first embodiment to provide interim pads which are then separated into their constituent components and recombined with components of opposite character to provide two resultant composite pads, one of which is illustrated in FIG. 9. The other composite pad would be identical to the pad of FIG. 9 but would have element 82 constituting the hard component and element 80 constituting the soft component. It will be observed that the soft component 82 of the FIG. 9 embodiment consists of semi-circular end portions 83 joined by linear side elements 84. The remainder of the soft component of FIG. 9 consists of linear arm members 86 extending inwardly from central portions of said linear side elements, parallel internal linear elements 88 are perpendicular to said linear side arm members, curved connector portions 92 extending from opposite ends of parallel internal linear elements 88 and parallel innermost linear element 90 extending toward the center of the pad from opposite curved connector portions 92. The curved connector portions 92 have an arcuate extent of approximately 90°. The hard component 80 is matingly fitted in the aforementioned constituents of the soft component and comprises inwardly facing U-shaped portions 94, a longitudinal central portion 95 extending between the inwardly facing portions 94, and two T-shaped portions comprising elements 96 and 97 extending transversely from opposite sides of the center of the longitudinal center portion 95.

Thus, it would be appreciated that the present invention in all of its embodiments provides a uniquely improved economical and easy to fabricate shock absorptive pad capable of usage in wide variety of ways. The inventive method precludes the loss of any appreciable materials in the fabrication process and requires a minimum of labor. While numerous modifications of the disclosed embodiments will undoubtedly occur to those of skill in the art, it should be understood that the spirit and scope of the invention is to be limited solely by the appended claims.

I claim:

1. A method of forming composite shock absorbing padding of first and second materials having different hardness, said method comprising the steps of die cutting mats of said first and second materials by the use of identical dies or a single die to provide (interim) transient pads formed of a single material and comprising first and second mating constituent components;

disassembling the interim pad components; and associating each constituent component formed from the first material with a mating constituent component of the second material to provide a composite pad formed of interleaved harder and softer materials.

2. The method of claim 1 wherein said constituent components each include a plurality of parallel finger elements extending from a common base element of each constituent component.

3. The method of claim 2 wherein said constituent components each comprise a series of interconnected L-shaped elements.

4. The method of claim 1 wherein one of said constituent components comprises a series of connected H-shaped elements received within the other constituent component.

5. The method of claim 1 wherein said constituent components each comprise a series of linear fingers connected to form square spirals.

6. A shock absorbing pad formed of first and second constituent components respectively comprising materials of different hardness and each including a plurality of parallel elements extending from a common base element of each constituent component wherein said elements of each of the different constituent components are interleaved with the elements of the other constituent component.

7. A shock absorbing pad as recited in claim 6 wherein one of said constituent components comprises a series of connected H-shaped elements positioned within the other constituent component.

8. A shock absorbing pad as recited in claim 6 wherein said constituent components each comprise a series of linear fingers connected to form a square spiral.

9. A shock absorbing pad as recited in claim 6 wherein said constituent components each comprise a series of interconnected L-shaped elements.

10. A relatively flat shock absorbing pad having thickness, length, and breadth dimensions with the thickness dimension being substantially less than the other dimensions comprising first and second interleaved constituent components formed of materials of different hardness with both constituent components extending through the entire thickness of said pad for absorbing forces applied to the pad in the direction of the pad thickness.

11. A shock absorbing pad as recited in claim 10 wherein one of said constituent elements comprises an enclosing member in which the other constituent element is enclosedly positioned, said enclosing member including semicircular end portions joined by linear side elements, linear arm members extending inwardly from central portions of said linear side elements, parallel internal linear elements extending perpendicularly from the inner extent of said linear arm members, inwardly curved connector portions extending inwardly from opposite ends of said parallel internal linear elements and parallel innermost linear elements 90 extending toward the center of the pad from one end of each of said inwardly curved connector portions, said other constituent element comprising two U-shaped inwardly facing portions each respectively positioned between one semicircular end portion, a portion of a linear side element, the linear arm members, a portion of the parallel internal linear elements and two of the inwardly curved connector portions, said other constituent element further including a longitudinal central portion extending between the inwardly facing U-shaped portions and first and second T-shaped portions extending transversely from opposite sides of the longitudinal central portion.

12. A shock absorbing pad as recited in claim 10 wherein one of said constituent components comprises a series of connected H-shaped elements positioned within the other constituent component.

13. A shock absorbing pad as recited in claim 10 wherein said constituent components each comprise a series of linear fingers connected to form a square spiral.

14. A shock absorbing pad as recited in claim 10 wherein said constituent components each comprise a series of interconnected L-shaped elements.

15. A shock absorbing pad as recited in claim 10 wherein the base element of one of said constituent components has a length exceeding the length of the base element of the other constituent component by an amount equal to the width of one of the fingers of the other constituent component.

* * * * *